US008662335B2

(12) United States Patent
Van Romer

(10) Patent No.: US 8,662,335 B2
(45) Date of Patent: Mar. 4, 2014

(54) ALL-TERRAIN BERM

(75) Inventor: Edward W. Van Romer, Anderson, SC (US)

(73) Assignee: Basic Concepts, Inc., Anderson, SC (US)

( * ) Notice: Subject to any disclaimer, the term of this patent is extended or adjusted under 35 U.S.C. 154(b) by 1642 days.

(21) Appl. No.: 11/588,130

(22) Filed: Oct. 26, 2006

(65) Prior Publication Data

US 2007/0278225 A1 Dec. 6, 2007

Related U.S. Application Data

(63) Continuation-in-part of application No. 11/442,825, filed on May 30, 2006.

(51) Int. Cl.
*A45C 7/00* (2006.01)

(52) U.S. Cl.
USPC ..... 220/9.2; 220/9.1; 405/107

(58) Field of Classification Search
USPC ..... 220/9.1–9.4, 495.11, 573, 476, 23.87, 220/23.89; 405/115, 116, 284, 129.75, 405/129.8, 107; 588/900
See application file for complete search history.

(56) References Cited

U.S. PATENT DOCUMENTS 1,307,942 A * 6/1919 Volters ..... 4/587
2,378,159 A * 6/1945 Royer ..... 220/565
2,749,956 A * 6/1956 Eldred ..... 220/9.3
4,064,579 A * 12/1977 Winther ..... 5/687
4,136,995 A * 1/1979 Fish ..... 405/115
4,356,933 A * 11/1982 Connolly ..... 220/9.4
4,511,286 A * 4/1985 Hardacre ..... 405/115
5,090,588 A * 2/1992 Van Romer et al. ..... 220/573
5,316,175 A * 5/1994 Van Romer ..... 220/573
5,511,683 A * 4/1996 Dailey ..... 220/573
5,592,702 A * 1/1997 Gillebaard, Jr. ..... 4/506
5,762,233 A * 6/1998 Van Romer ..... 220/573
5,924,461 A * 7/1999 Shaw et al. ..... 141/86
5,948,250 A * 9/1999 Middleton ..... 210/232
6,019,243 A * 2/2000 Marino ..... 220/573
6,079,904 A * 6/2000 Trisl ..... 405/107
6,092,686 A * 7/2000 Shaw et al. ..... 220/573
6,315,495 B1 * 11/2001 Starheim ..... 405/129.8
6,558,769 B1 * 5/2003 Chwala ..... 428/137
6,561,372 B1 * 5/2003 Connolly ..... 220/9.1
6,643,858 B2 * 11/2003 Lee ..... 4/506
6,742,198 B2 * 6/2004 Lee ..... 4/506
6,880,720 B2 * 4/2005 Van Romer ..... 220/573
6,880,721 B1 * 4/2005 Barrett et al. ..... 220/573

(Continued)

*Primary Examiner* — Anthony Stashick
*Assistant Examiner* — Christopher McKinley
(74) *Attorney, Agent, or Firm* — J. Bennett Mullinax, LLC

(57) ABSTRACT

A system including transportable all-terrain berm for receiving and retaining fluid. The berm includes flexible impervious sheeting generally formed of a coated fabric. The sheeting is shaped to include a floor area surrounded with opposed end and side wall sections forming a containment area. The end and side walls include adjacent their outer edges spaced retaining and support members. The berm includes a plurality of A-frame braces arranged in vertical positions about the flooring for supporting the end and side wall sections. Stabilizer members are engaged with the upper ends of adjacent braces. The retaining and support members are engaged with the brace members and the stabilizer members holding the end and side walls in generally elevated positions and in engagement with the braces forming the containment area. A bladder for containing and dispensing fluid may be located in the containment area, in which case the berm protects against bladder spillage while providing structural support.

30 Claims, 10 Drawing Sheets

(56) References Cited

U.S. PATENT DOCUMENTS

| | | | | |
|---|---|---|---|---|
| 6,953,127 | B1 * | 10/2005 | Esser | 220/9.3 |
| 7,036,676 | B2 * | 5/2006 | Christensen | 220/565 |
| 7,188,747 | B2 * | 3/2007 | Bennett et al. | 220/565 |
| 2003/0029873 | A1 * | 2/2003 | Moffat et al. | 220/573 |
| 2003/0156903 | A1 * | 8/2003 | Wiseman et al. | 405/115 |
| 2004/0096276 | A1 * | 5/2004 | Startteim et al. | 405/129.8 |
| 2004/0169041 | A1 * | 9/2004 | Van Romer | 220/573 |
| 2005/0051547 | A1 * | 3/2005 | Van Romer | 220/9.1 |

* cited by examiner

ALL-TERRAIN BERM

CROSS REFERENCE TO RELATED APPLICATION

This application is a continuation-in-part of application Ser. No. 11/442,825, filed May 30, 2006 having the same title.

BACKGROUND OF THE INVENTION

The invention is directed to a large capacity transportable berm for use in emergency, temporary or military situations, which is adaptable for use on substantially all-terrain.

Numerous situations arise where transportable berms, containments or flexible bladders are both useful and necessary. A primary use of these is with military operations where fluid, whether it be drinking water, waste water or contaminating materials such as petroleum and other similar products, need to be contained for storage or later proper disposal. Disaster areas also require the use of containments for the temporary storage of the above referred to fluids. Finally, in areas of extremely fast growth, there sometimes is a need for a temporary containment.

The instant invention has for a primary object a transportable containment capable of retaining large volumes of fluid for later distribution or disposal.

Another object of the invention is a transportable berm which can be easily and quickly assembled or disassembled.

Another object of the invention is a transportable berm capable of retaining large volumes of fluid over an extended period of time.

Another object of the invention is a system which includes a transportable berm capable of receiving and supporting a filled bladder against rupture and spillage.

Another object of the invention is a transportable berm constructed with a splash guard to prevent unwanted spillage.

Another object of the invention is a system for preventing rupture and spillage of a fluid containing bladder.

Another object of the invention is a large capacity berm which is capable of being easily disassembled and folded or arranged in small units for storage and transport.

SUMMARY OF THE INVENTION

The invention is directed to a transportable all-terrain berm for collecting fluid. The berm is comprised of flexible impervious sheeting material configured to form a floor, which may be supported in a generally horizontal position, and opposed side and end wall sections which are connected along first edges with the floor and together along opposed ends. Retaining members are arranged to extend from second edges of the side and end wall sections at selected spaced positions. Also, support members are arranged to extend from the second side edges of the side and end wall sections at locations between the retaining members.

A plurality of braces, preferably A-frames, are positioned about the flooring in generally vertical positions. Each brace or A-frame comprises first and second legs pivotally engaged at least one of their upper ends. A spacer member is provided for selectively positioning and maintaining the lower ends of the first and second legs in spaced positions. A hook member may be located on an outer surface of one of the first and second legs adjacent its upper end for engagement with a retaining member.

The retaining members comprise loops formed of straps which are affixed with the side sections adjacent the side edges spaced from the floor. The loops engage over the upper ends of said brace members and with the hook members.

The support members comprise straps affixed adjacent the second side adjacent of the side and end members which are formed into loops, which are arranged between adjacent of the support members. Alternatively, the support members may comprise flexible sheeting extending from the second edge of the end and side members which are formed into an extended loop which extends between the retaining members.

A stabilizer, generally comprising a rod having down-turned ends, is engaged with upper ends of the braces interconnecting adjacent ones. The support members are engaged over the stabilizers.

The A-frames may be spaced at generally between 2 and 6 foot intervals, depending upon the weight of the product, along said side and end wall sections with spacings at the corners being slightly less.

The berm is a collapsible berm capable of being folded for storage and transport. The berm is also capable of being assembled to form a containment area for collecting or storing fluid. The containment area, which is formed of flexible impervious sheeting, includes a generally flat floor area surrounded by opposed generally vertical side and end walls. A plurality of braces are arranged in vertical positions about the flooring in position to engage with the end and side walls. There are retaining members and support members which are engaged with and positioned outwardly of and about the end and side walls.

Stabilizer members, which engage with and extend between adjacent of the braces, are adapted to engage with the support members to assist in maintaining the side and end walls in generally vertical positions.

The braces are preferably formed of U-shaped metal beams pivotally joined. Side sections of the metal beams overlap and form the pivot. An opening is formed adjacent the upper end of the braces which is designed to receive the down-turned ends of the stabilizer members.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
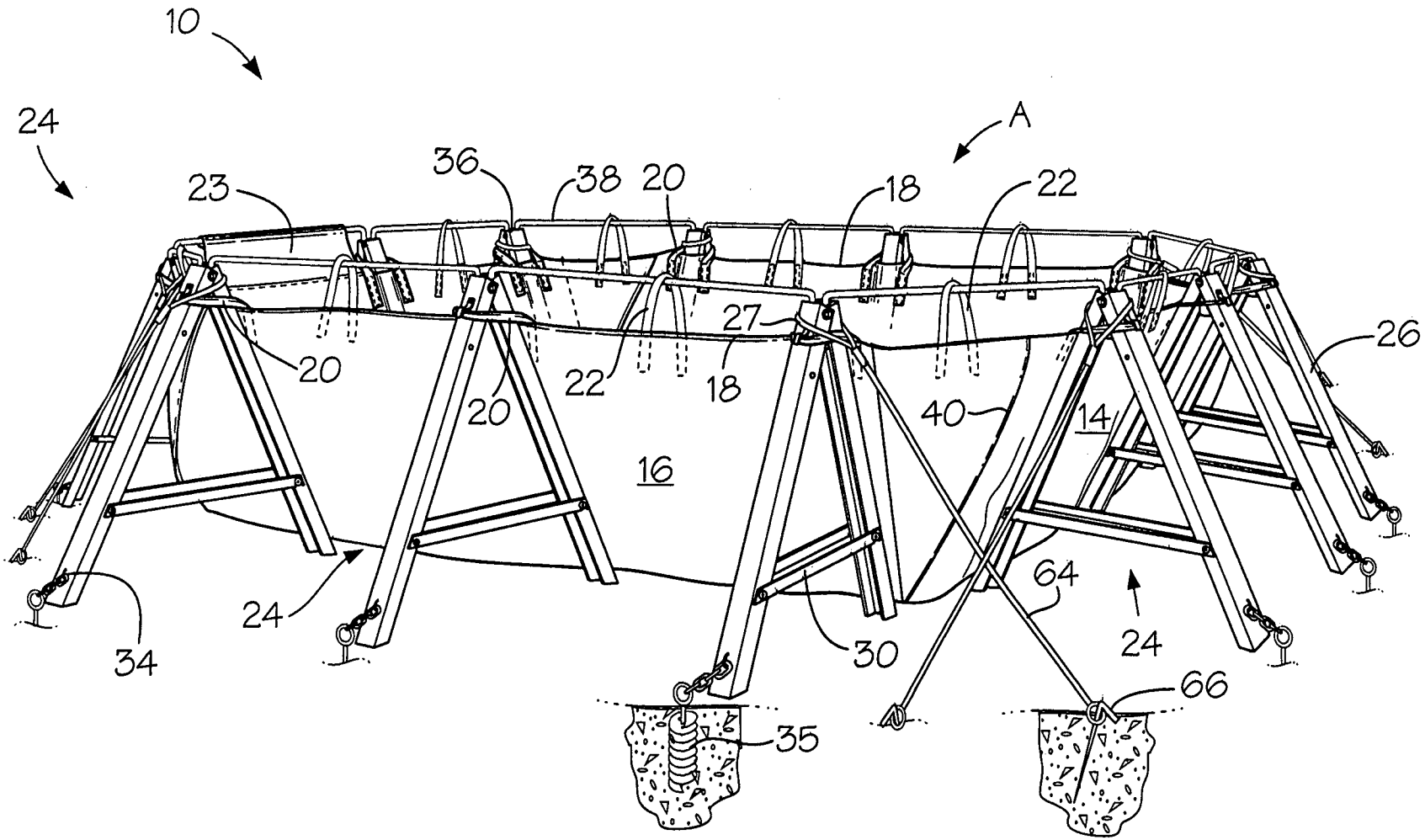
FIG. 1 is a perspective view of the all-terrain berm in assembled condition.

Turning now to FIG. 1, a primary version of the all-terrain berm or ATB transportable containment berm of the invention is shown in its assembled position at 10. Berm 10 is formed of flexible impervious sheet material, usually a fabric coated with synthetic material. The berm comprises a containment area A which includes a floor 12, see FIG. 5, opposed end walls 14 and opposed side walls 16, each engaged along their inner edge with an edge of flooring 12 and along opposed edges with each other forming containment area A. End and side walls are preferably of equal height of between 2 feet and 4 feet. Retaining members 20 are secured adjacent outer edges 18 of side and end walls 14 and 16 in substantially equally spaced positions. Between retaining members 20 and along edges 18 there are provided support members 22 and/or 23.

Figure 4A:
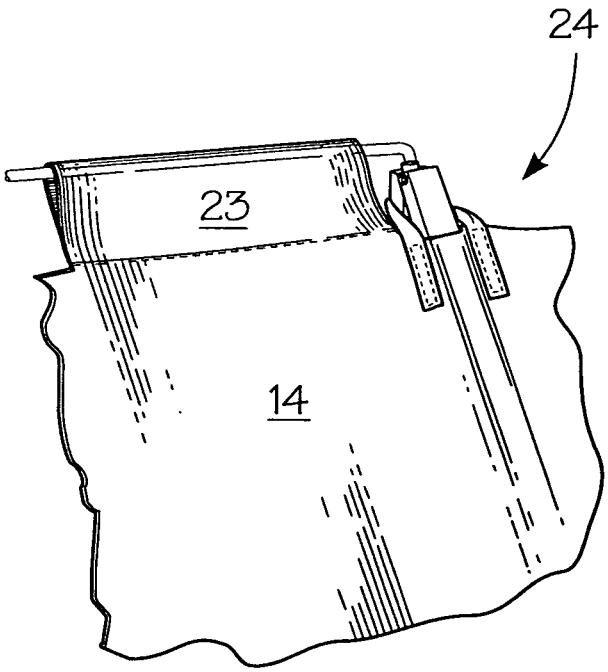
FIG. 4A is an exploded view of a retaining and support member engaged with an A-frame and stabilizer member.
Figure 4B:
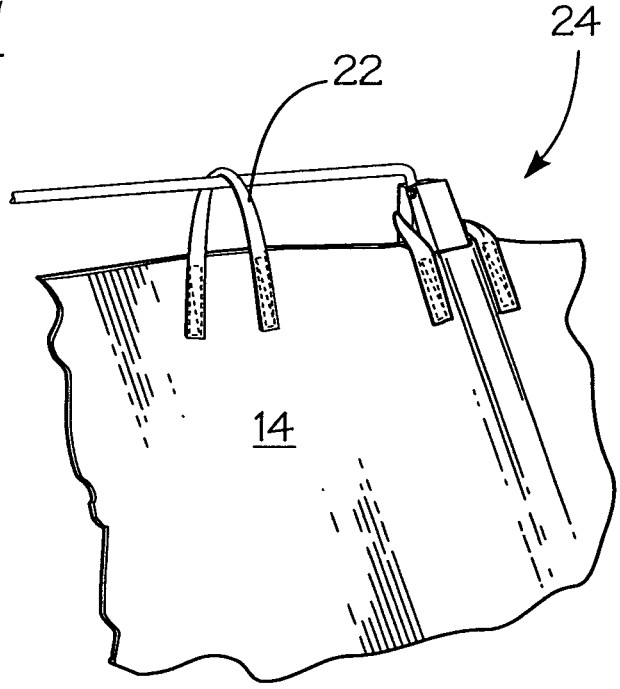
FIG. 4B is an exploded view of another arrangement of a support member and a retaining member engaged with an A-frame and stabilizer member.

Both retaining members 20 and support members 22 may comprise straps secured adjacent their opposed ends with end and side walls 14 and 16 forming loops which extend beyond edges 18. The straps are generally woven and are of a heavier material than the flexible sheet material. Alternatively, the support members may comprise an extension of the flexible sheet material extending between adjacent retaining members 20 and formed into a loop as shown at 23. See also FIGS. 4A and 4B.

The flexible sheeting material may comprise a fabric, formed of natural or synthetic materials which may be woven, knitted or non-woven which is coated with a synthetic material. The coating material must be resistant to degrading when contacted with petrochemicals or other contaminants which are desired to be retained. Polyurethane is generally a suitable coating. The flexible sheeting must be of sufficient strength to resist tearing under the pressure created by the contained fluid. The flexible sheeting must also resist undue wear due to the berm being set up and taken down repeatedly. Suitable fabrics are manufactured by several known manufacturers, two of which are the Seaman Corporation of Wooster, Ohio, and Cooley. Inc. of Pawtucket. R.I.

A plurality of braces 24 or A-frames, best seen in FIGS. 1-3B, are provided to assist in retaining the side and end walls 14, 16 in generally vertical positions. Each brace 24 preferably comprises an A-frame comprised of a pair of U-shaped metal beams 26 joined adjacent upper ends with a pin 28 forming a pivotal connection. Adjacent the lower ends of beams 26 there is provided a spacer 30 which, when engaged with spaced beams 26, maintains them generally in the form of an inverted V and in fixed position.

Beams 26 include spaced and parallel side edges 32 through which bores pass to receive pins 28 and 29 which secure the A-frame in position. Pin 29 may be used to also secure spacers 30 in positions parallel with beams 26 when the brace is in its collapsed position for storage or transport.

Adjacent lower ends of beams 26 an additional bore 34 is provided to receive an anchor which acts to secure brace 24 in fixed position with the ground or its supporting surface. The anchor may comprise a peg or screw pin passed through bore 34 and into the ground or support surface. Alternatively, the anchor may comprise a cord or chain secured at one end with beam 26 and at its other end with peg or screw 35, which is then embedded in the ground as shown in FIG. 1.

Adjacent the upper end of brace 24 is provided a hook 27 or other suitable securing member. Also, adjacent the same upper end, overlapping parallel sides 32 of beams 26 form an enclosed opening 36.

Rods having down-turned opposed ends form stabilizers 38. Each stabilizer is preferably formed to be between 2 and 6 feet in length with the down-turned ends being between 4 and 6 inches in length. The stabilizers, which are located at the corners of the containment, may be slightly shorter than the stabilizers extending along the end and side wall sections, i.e. between 1.5 and 4.5 feet depending on the placement of the braces 24.

Figure 2A:
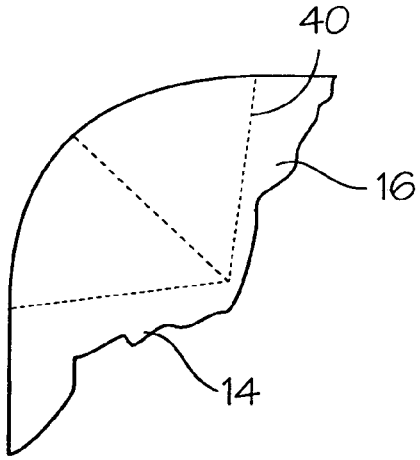
FIG. 2A is a sectional top view of the corner structure of the flexible sheeting.
Figure 2B:
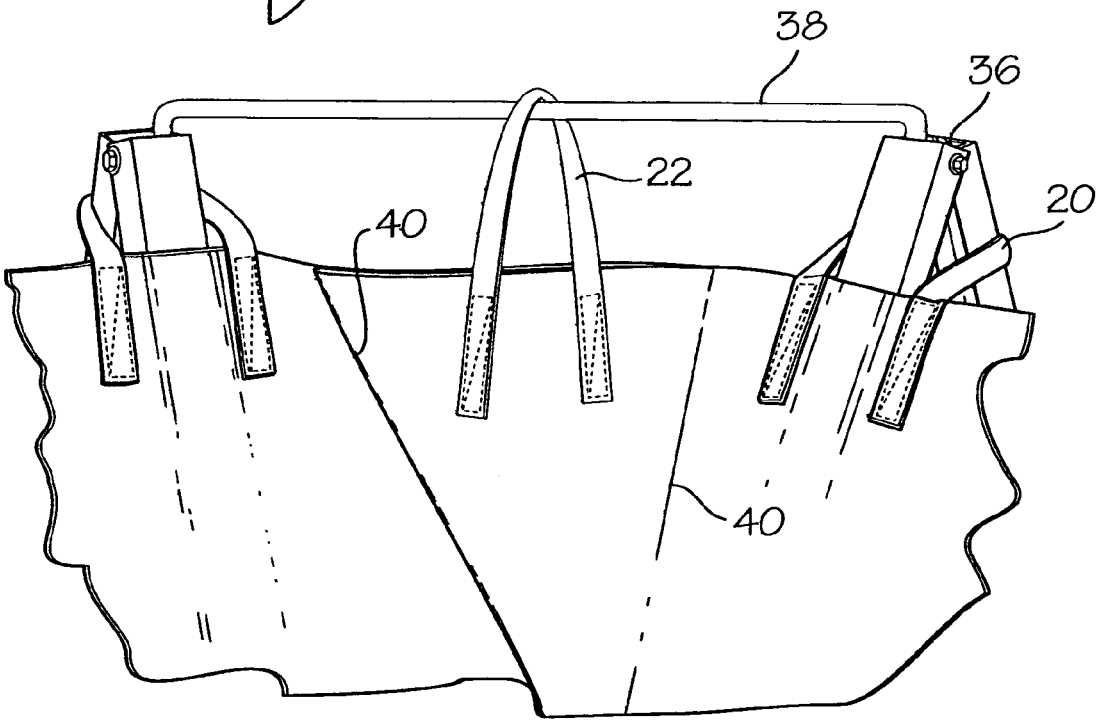
FIG. 2B is a sectional side view of a corner section formed by the end side walls.
Figure 3A:
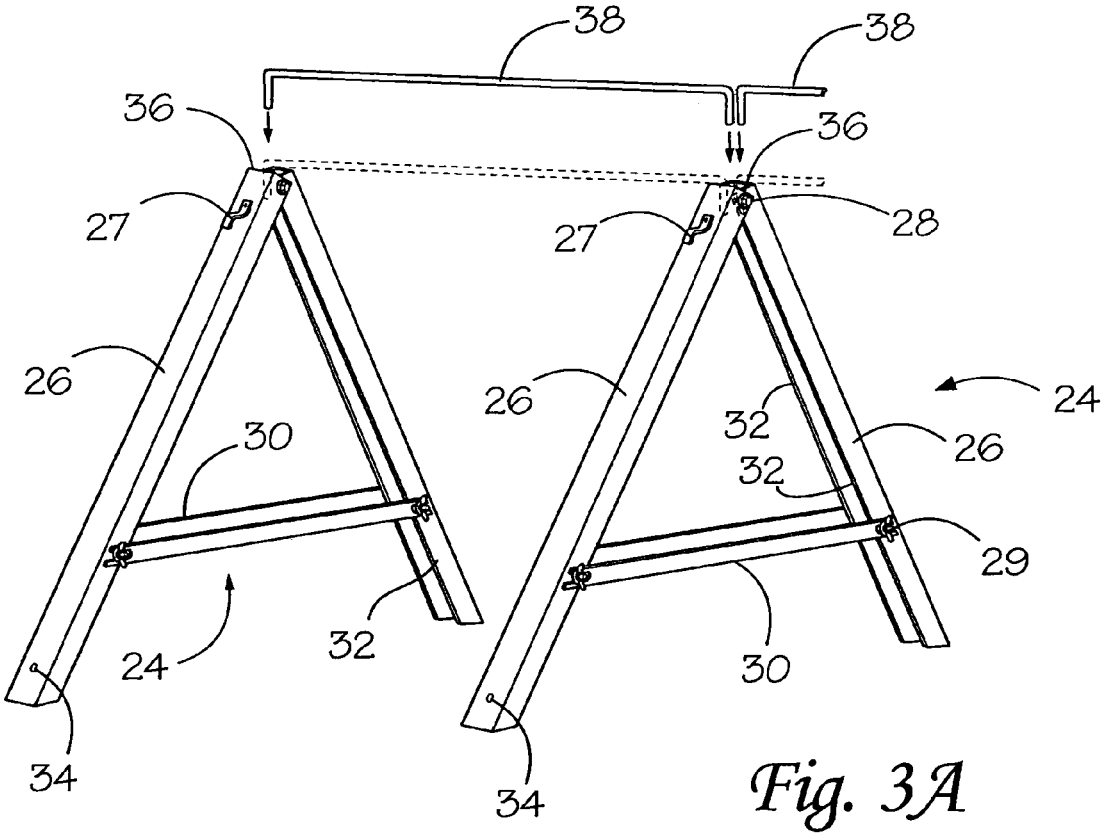
FIG. 3A is a perspective view of a pair of A-frames associated with a stabilizer member.
Figure 3B:
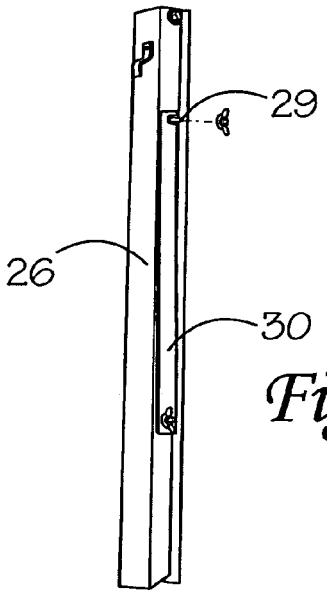
FIG. 3B is a side view of an A-frame in folded condition.
Figure 5:
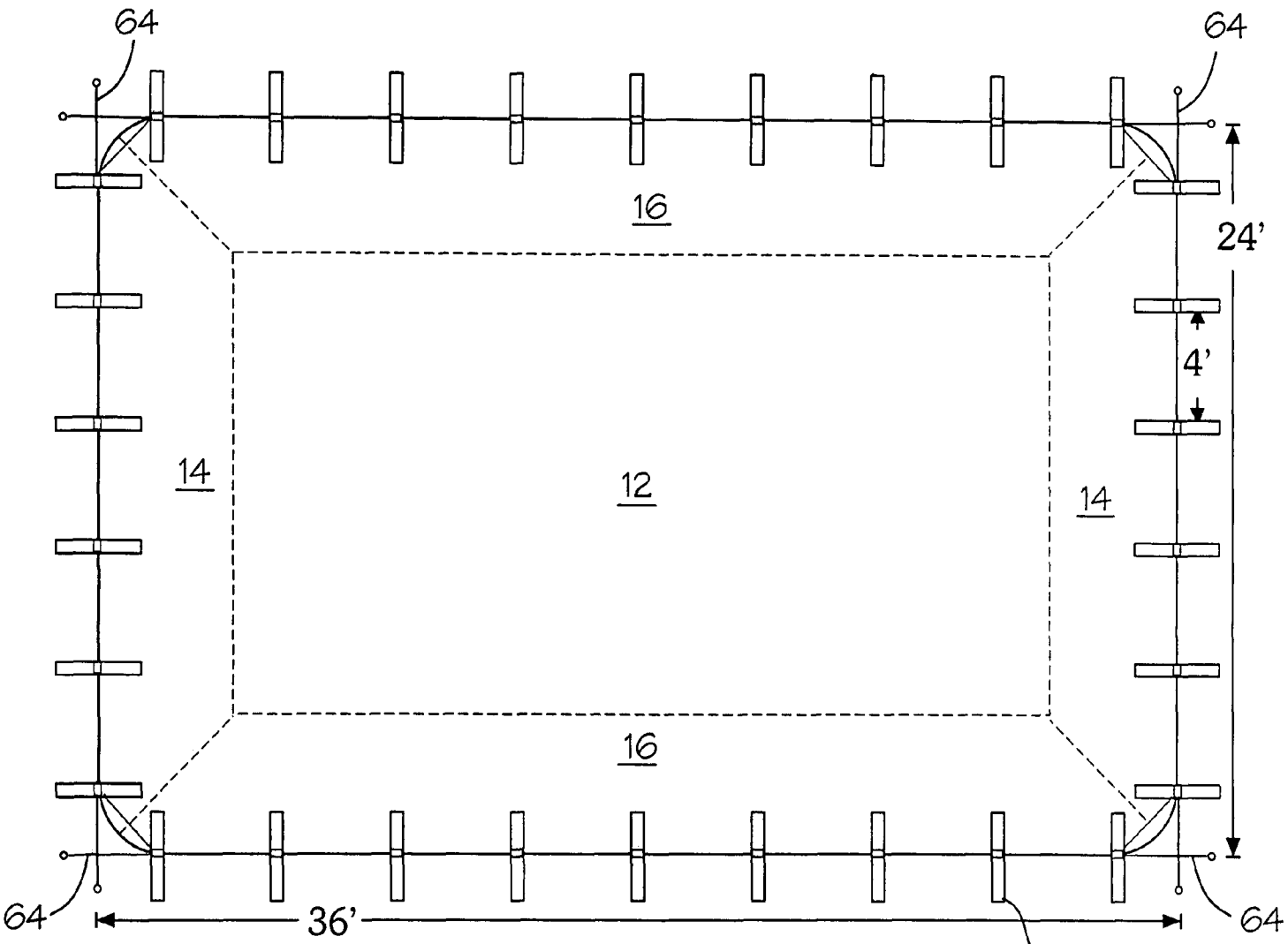
FIG. 5 is a top diagrammatic view of the assembled berm.

The corner sections are slightly rounded and are shown in FIGS. 2A, 2B and 5. Each corner is formed by folding excess of the flexible sheet material, to overlap and then heat sealed along lines 40 as shown in FIG. 2B. A support member 22 may be attached along this section to retain the corner in the vertical position as shown.

Additionally, secondary bracing in the form of two straps or rods 64 which are attached at each corner may be necessary when large volumes of fluid are contained. These straps are connected over the upper pivoted end of braces 24 which are adjacent the corners. The straps are drawn downwardly and away from containment 16, where they are secured with the ground or support surface by spikes 66.

It is noted that the corner forming arrangement of the flexible sheet material forms no part of the instant invention and any known corner forming arrangement is acceptable.

Turning now to FIGS. 1 and 5, a perspective view and a top view of the general arrangement of the berm of the invention is shown. Braces 24 are preferably arranged in equally spaced positions, i.e. between about 2 to 6 feet apart, along both the side and end walls 14, 16. Braces 24 are positioned about 2 feet from each corner section. Stabilizers 38 are engaged in openings 36 adjacent the top of the braces. Flexible sheeting, with dimensions of about 24'×32', is positioned within the arranged braces 24 with side and end walls 14, 16 in engagement with inner legs 26 of braces 24. It is noted these dimensions may be larger or smaller as desired. Retaining members 20 are secured over the upper ends of the braces and in engagement with hook 27. Also, support members 22 or 23 are engaged over stabilizers 38. The retaining members and support members act to hold the end and side walls in a generally vertical position and in engagement with the inner leg of brace members 24. Stabilizers 38 further act to maintain the braces in vertical positions. Straps or rods 64 secure with braces 24 adjacent each corner section to provide additional support for these areas.

Berm 10 is designed to be arranged in a disassembled condition for transport and storage. In the disassembled condition, the flexible sheet forming the flooring and the end and side walls is folded into a generally flat, generally rectangular or square condition which can be accommodated in a minimum space. The braces are put in closed position with the legs in parallel engagement. The braces, along with the stabilizers, are then arranged together and located with the flexible sheeting.

In this disassembled condition, berm 10 may be transported to a point of need where the flooring of the flexible sheet is laid out on the available terrain. The braces are assembled into their A-frame configuration and positioned about the periphery of flooring 12. The stabilizers 38 are engaged with frames 24 fixing them in position. The side and end walls are brought up into their generally vertical position and the retaining and support members are engaged with the braces and stabilizers securing the side and end walls in substantially vertical positions. In this condition, berm 10 is assembled.

It is to be noted that it may be desirable to attach a cover sheet with the upper edges of the side and end walls. The cover sheet may be permanently or removably attached at one or a multiple of edges. The cover is desirable when protecting the content of the bladder from airborne impurities and debris. The cover is especially desirable when drinking water is being stored. The cover sheet is generally of the same material as the material forming the berm.

Figure 6:
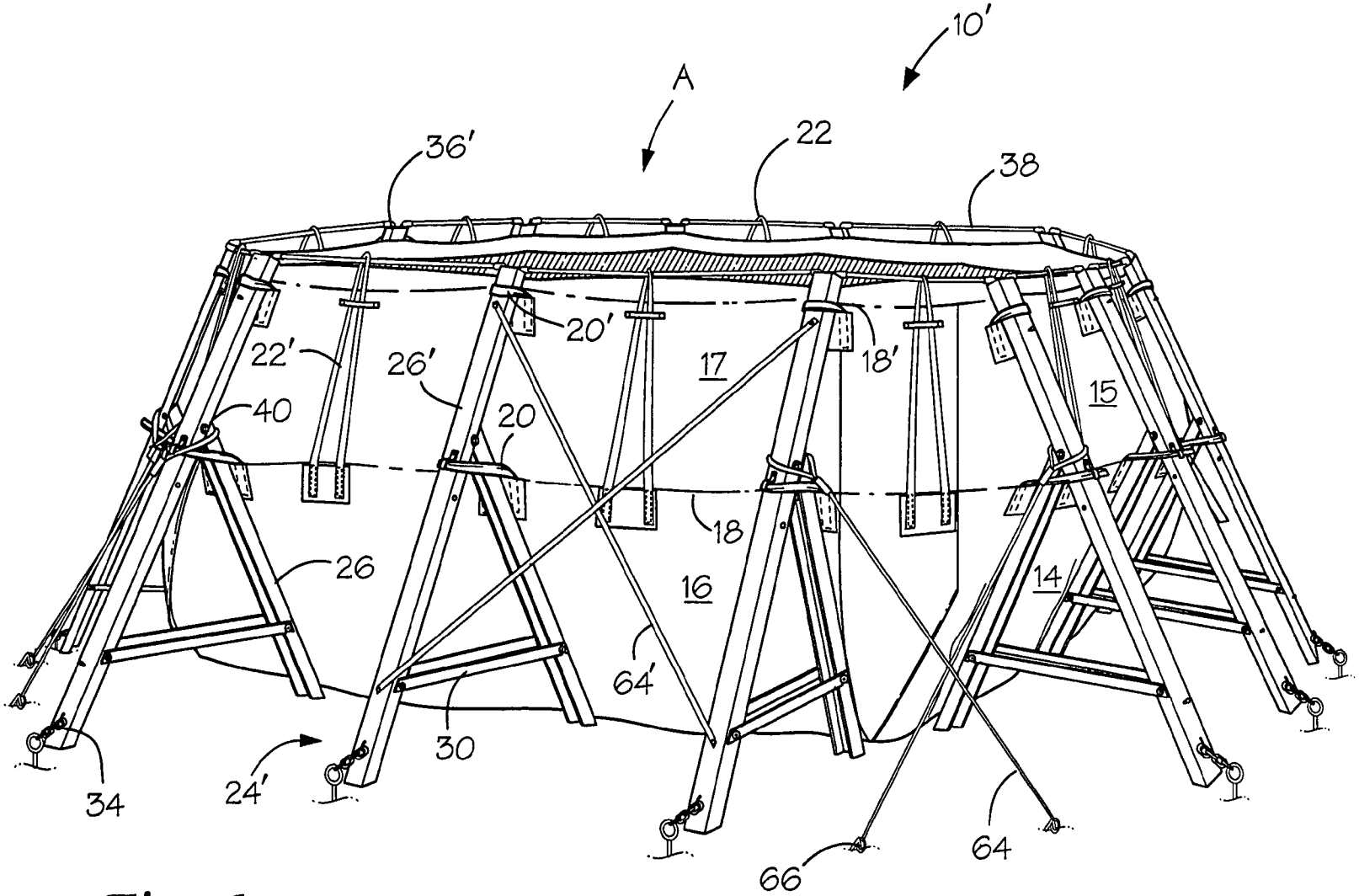
FIG. 6 is a perspective view of an alternative arrangement of the all-terrain berm of the invention.

Turning now to FIG. 6, an alternative arrangement of the berm is shown at $\mathbf{10}^1$. Berm $\mathbf{10}^1$ is substantially of the identical structure as the earlier described berm 10 with the exception that end and side walls 14 and 16 have attached along their upper edges 18 side and end wall extensions 15 and 17 which are of an equal height of between 1 foot and 3 feet. Retaining members 20 may be provided as in berm 10 along with secondary retaining members $\mathbf{20}^1$ which are secured in selected locations adjacent the upper edge of wall extensions 15, 17. Support members $\mathbf{22}^1$ are secured adjacent upper edge 18 and are of a length to extend beyond edge $\mathbf{18}^1$. The support members may be engaged with extensions 15 and 17 adjacent the upper edge with any suitable means as shown in the drawing.

A-frames or braces $\mathbf{24}^1$ are provided to support or retain containment $\mathbf{10}^1$ in an operative condition substantially as in FIG. 1. Each brace $\mathbf{24}^1$ includes an inner leg 26 and an outer leg $\mathbf{26}^1$. Inner leg 26 is as earlier described while outer leg $\mathbf{26}^1$ is lengthened by a length substantially equal to the height of extensions 15 and 17. The upper end of legs $\mathbf{26}^1$ are closed to form a receiving and retaining area for the turned down ends of stabilizer rods 38. Leg 26 is pivotally connected with leg $\mathbf{26}^1$ at 40 which is substantially the same point longitudinally that legs 26, $\mathbf{26}^1$ are pivoted together. Spacer 30 is provided to lock brace $\mathbf{24}^1$ in the upstanding position. Stabilizers 38 and retaining members 20 are engaged with braces $\mathbf{24}^1$ as earlier described while retaining members $\mathbf{20}^1$ are engaged over upper ends of legs $\mathbf{26}^1$ and supports $\mathbf{22}^1$ engage with the stabilizers to hold end and side walls 14, 16 along with extensions 15 and 17 in a generally elevated position. The outer sides of the walls and extensions in their generally vertical positions engage against legs 26 and the upper portion of extension $\mathbf{26}^1$. Due to the angle of the inner and outer legs, the end and side walls are held in a slightly concave position.

Straps or rods 64 may be utilized to support the corners while rods $\mathbf{64}^1$ may be engaged with adjacent braces $\mathbf{24}^1$ for additional stabilization of the brace members. It is noted that in certain conditions, a single pair of rods $\mathbf{64}^1$, secured along each end and side wall, may sufficiently stabilize the braces. These straps or rods may also be used in the arrangement shown in FIG. 1.

Figure 7:
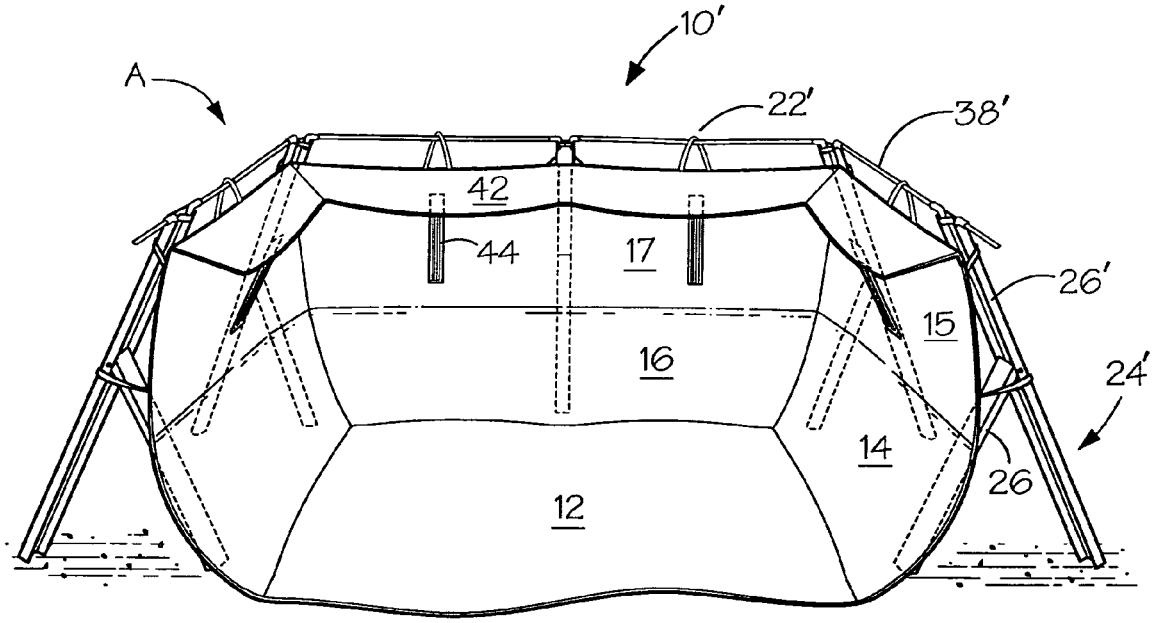
FIG. 7 is a cutaway side view of the berm arrangement shown in FIG. 6.
Figure 8:
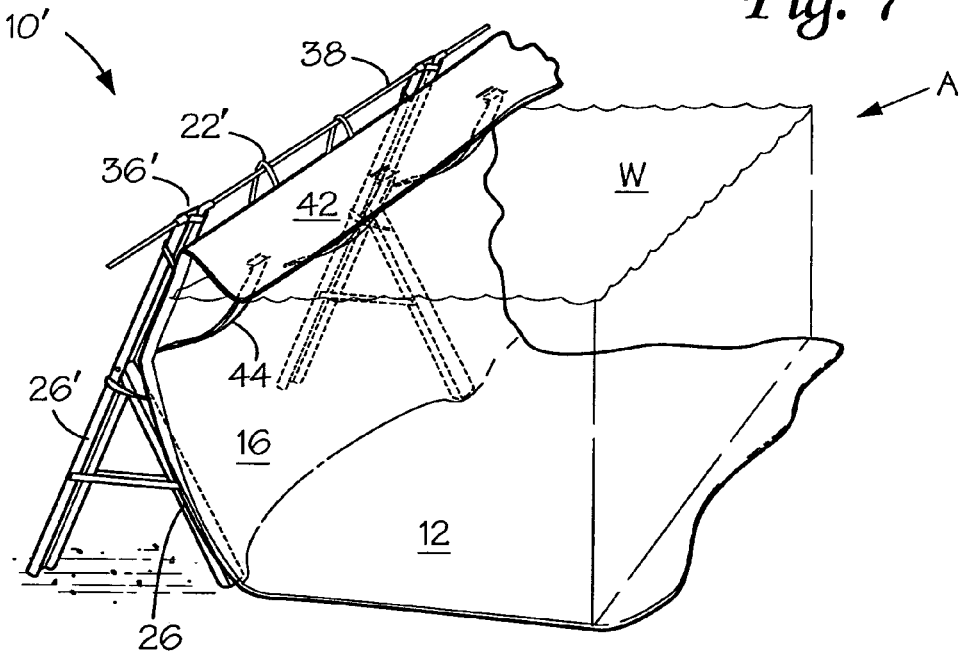
FIG. 8 is a cutaway side view similar to FIG. 7 showing the splash flap positioned relative to fluid level.

Turning now to FIGS. 7 and 8, sectional views of berm $\mathbf{10}^1$ are provided to more clearly show the relative positions of the inner surfaces of braces $\mathbf{24}^1$ and the outer surfaces of the berm. Also shown is an inwardly extending flap 42 which engages with and extends about the upper edge of extensions 15 and 17. A retaining member or strap 44 connects with extension 17 and the outer edge of flap 42 at selected locations about the containment area A. Straps 44 control the upward movement of flap 42 to generally the position shown in FIG. 8. Flap 42 is provided to prevent spillage over the upper edge of the containment area due to a sudden rush of fluid into the berm. FIG. 8 shows the level of fluid which may be contained in the berm.

Figure 9:
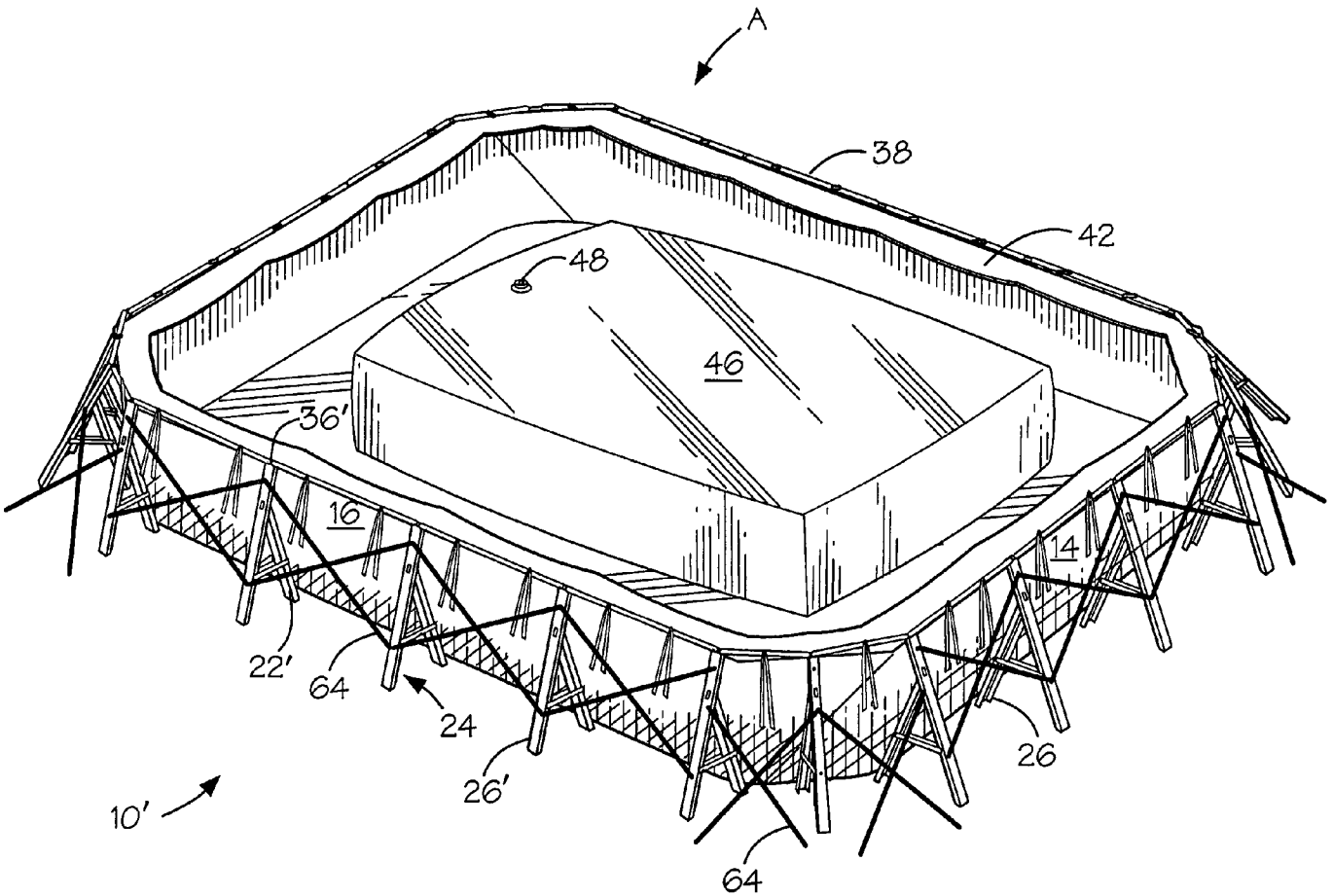
FIG. 9 is a perspective view of the arrangement shown in FIG. 6 to include a bladder positioned within the berm.

Berms 10 and $\mathbf{10}^1$ may be also employed to contain bladders such as bladder 46 shown in FIG. 9. In this arrangement, bladder 46 may be filled with water, sewage, petrochemicals or other containments in volumes of up to 500,000 gallons. The bladders are generally attached to piping through opening 48 for either filling or dispensing fluid. Due to the terrific pressure exerted by the large volume of fluid within the bladder and especially during periods of heat expansion, bladders have a tendency to rupture along their forming seams. Berm $\mathbf{10}^1$ is designed to contain the sudden rush of fluid flowing from the ruptured bladder without spillage over the walls 14, 16 of berm $\mathbf{10}^1$ due to end and side wall extensions 15, 17 and flap 42. The berm arrangement shown in FIG. 9 is another view of the berm arrangement described in FIGS. 6-8.

Bladder 46 is a known containment which generally resembles a large hot water bottle. Bladders are made in many sizes generally of an impervious flexible material similar to that forming berm 10. The construction of the bladder forms no part of the instant invention.

Figure 10A:
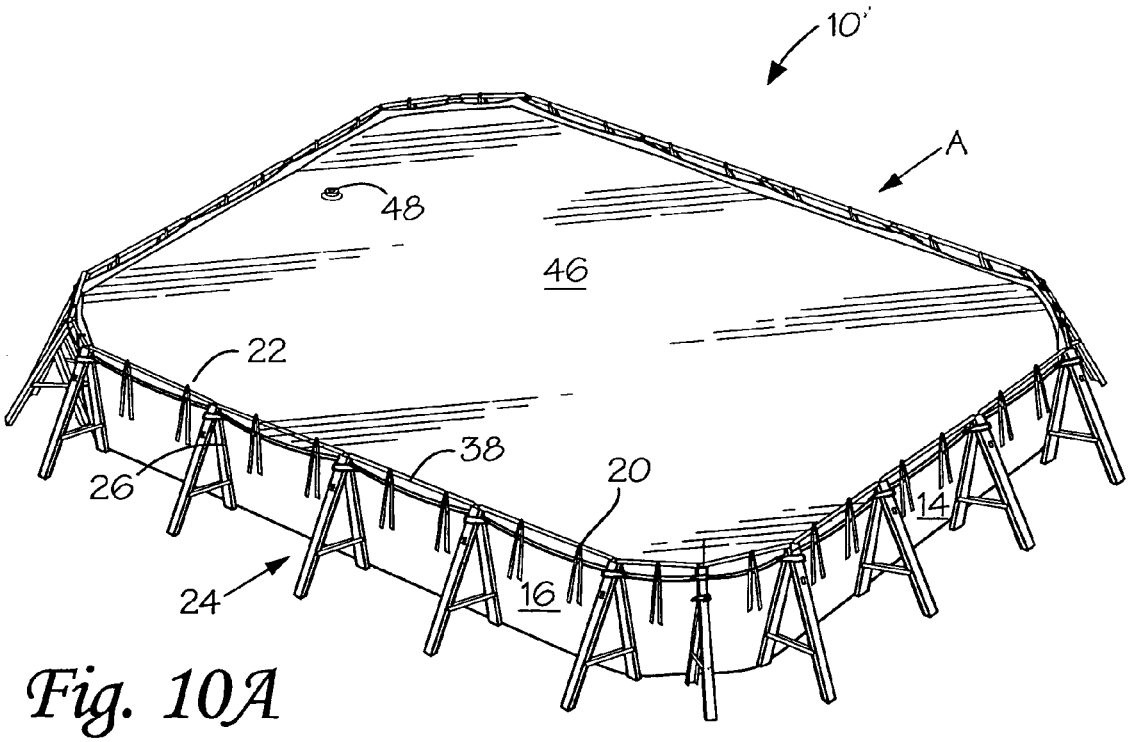
FIG. 10A is a perspective view of an arrangement in which a bladder is encased within the berm of FIG. 1.
Figure 10B:
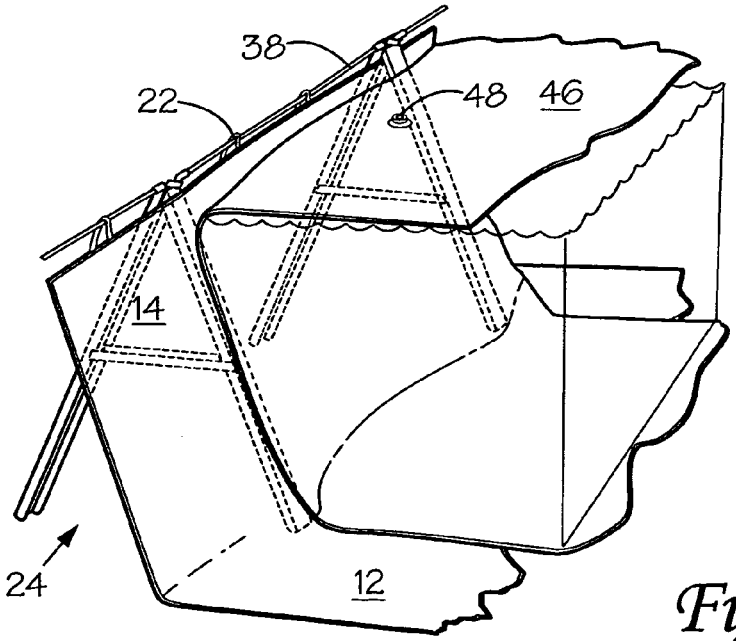
FIG. 10B is a cutaway perspective view of the arrangement of FIG. 10A showing the relative positions of the flexible material forming the berm, the support members and the bladder.
Figure 11A:
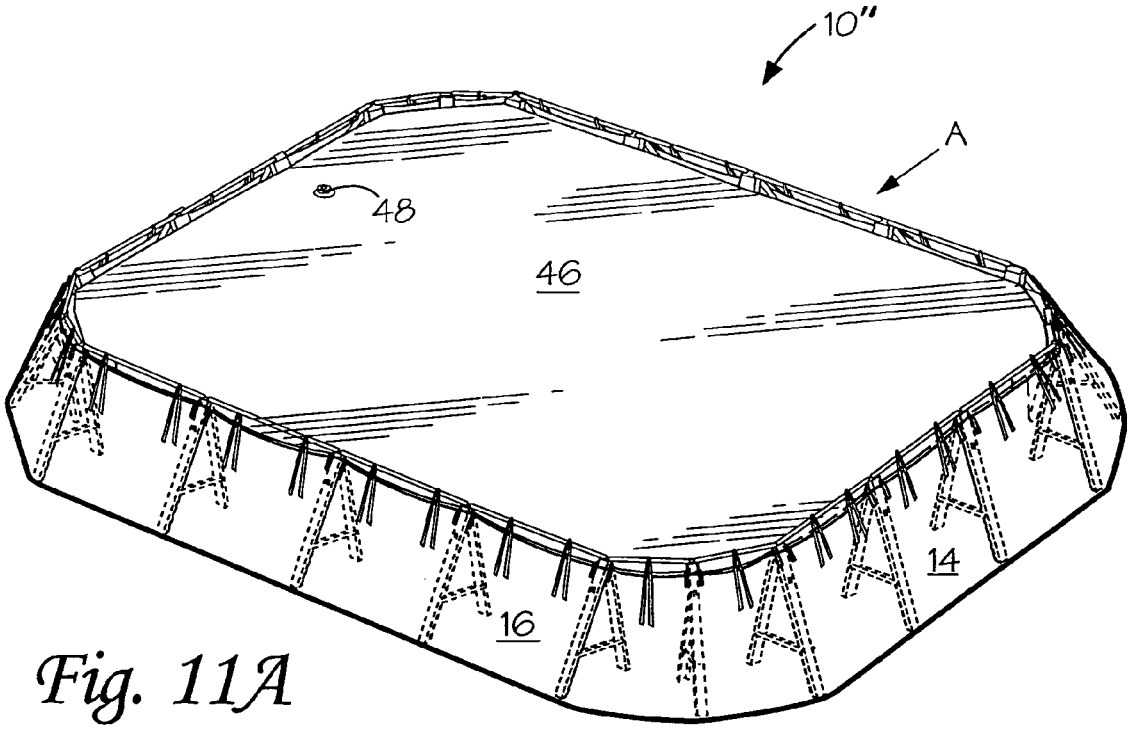
FIG. 11A is a perspective view of another arrangement in which a bladder is encased in a berm similar to that that of FIG. 1.

Turning now to FIGS. 10A and 11A, berm 10 along with berm $\mathbf{10}^1$ are shown with bladder 46 positioned in containment area A. In the arrangement shown in FIGS. 10A and 10B, berm 10 is exactly as disclosed in FIG. 1. Braces 24 are positioned about the circumference of containment area A with their inner legs 26 in engagement with side and end walls 14, 16 as previously disclosed. Positioned in juxtaposed position with side and end walls 14, 16 are the side and end wall portions of bladder 46. Side and end walls 14, 16 are shown as having a greater vertical height than that of bladder 46.

The bladders, because of varying demands, are of varying sizes ranging from around 100 gallons to greater than 500,000 gallons. They may be used to contain almost any type liquid ranging from water to petrochemicals. The larger size bladders, which are comprised of a plurality of sheets of flexible non-porous material joined together with heat sealed seams, have a tendency to separate when over-filled in hot conditions due to expansion of the contained fluid. By engaging or supporting the side sections of the bladder through engagement with the inner legs of braces 24, it has been found that the tendency to separate is greatly reduced.

Figure 11B:
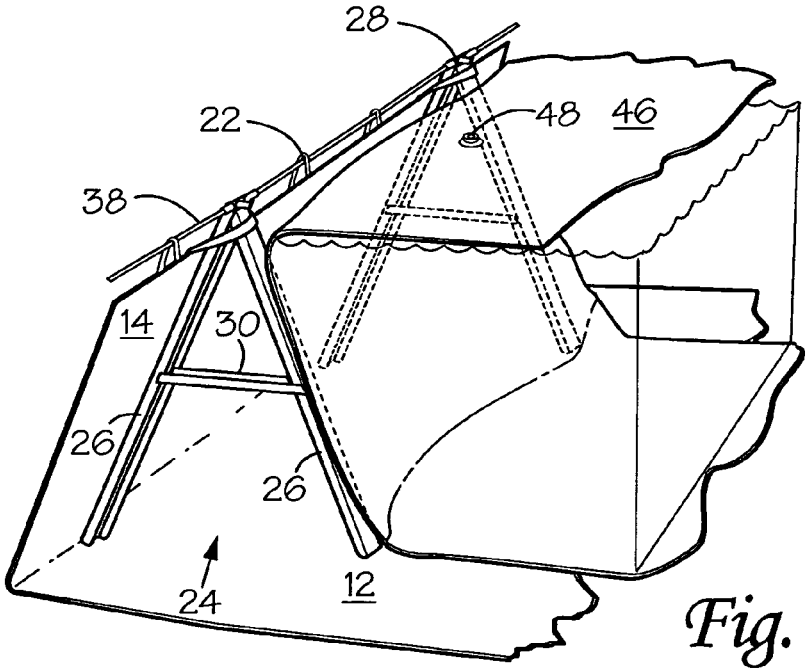
FIG. 11B is a cutaway perspective view of FIG. 11A showing the relationship of the flexible material forming the berm, the support members and the bladder.

Turning now to the arrangement shown in FIGS. 11A and 11B, the flexible sheeting forming the containment area A is exactly as described in the arrangements shown in FIGS. 1 and 10A. Braces 24 are also of the same structure. The difference is the manner of erecting berm $\mathbf{10}^{11}$ to form containment area A.

As shown in FIGS. 11A and 11B, the flexible sheeting is laid flat and braces 24 are positioned on floor 12 a distance from the outer edges equal to the height of side and end walls 14, 16. The outer portions are drawn up against outer legs 26 and connected with the upper ends of braces 24 and stabilizers 38 forming containment area A, as earlier described. Bladder 46 is then positioned in the containment area with its outer walls in contact with and supported by braces 24 as shown in FIG. 11B.

In the described condition, the berm is arranged to receive fluid for storage. The berm also may act to retain fluid which is to be removed at desired times and in desired amounts.

While a preferred embodiment of the invention has been described using specific terms, such description is for illustrative purposes only, and it is to be understood that changes and variations may be made without departing from the spirit or scope of the following claims.

What is claimed is:

1. A transportable all-terrain berm for collecting fluid comprising:

a containment area formed of flexible impervious sheeting having a floor adapted to lie in a generally horizontal position over a support surface and opposed side and end wall sections connected along first edges with said floor and connected together along opposed end edges;

retaining members extending from second edges of said side and end wall sections at selected spaced positions;

support members extending from said second edges of said side and end wall sections at locations between said retaining members; and a plurality of braces each having first and second upstanding legs pivotally engaged at a pivotal connection and including a spacer member for selectively positioning and maintaining lower ends of said first and second legs in spaced positions forming said braces generally in the form of an inverted V with the spacer member positioned above said lower ends of said first and second legs and with said lower ends of said first and second legs positionable against a supporting surface;

wherein said containment area is formed with said braces arranged in vertical spaced positions about said floor with upper ends of said braces engaged with said retaining members securing at least spaced sections of said side and end wall sections in generally vertical positions aligned and engaged with at least one of said legs of said braces.

2. The transportable all-terrain berm of claim 1 wherein said retaining members comprise straps affixed with said sides adjacent said second edges and formed into loops, said loops engaging over said upper ends of said braces.

3. The transportable all-terrain berm of claim 2 including hook members on selected of said legs, said straps being engaged with said hooks.

4. The transportable all-terrain berm of claim 1 wherein said first legs are longer than said second legs, said pivotal connection being adjacent an upper end of said second leg and an intermediate section of said first leg.

5. The transportable all-terrain berm of claim 1 wherein said support members comprise flexible sheeting extending from said second edges formed into an extended loop of more than 1 foot in width and arranged between at least certain of said retaining members.

6. The transportable all-terrain berm of claim 1 wherein certain of said support members are comprised of straps and certain of said support members are comprised of extended loops formed of flexible sheeting.

7. The transportable all-terrain berm of claim 1 wherein said first and second legs of said braces comprise U-shaped metal beams pivotally joined at said pivotal connection along parallel side extensions arranged in overlapping positions.

8. The transportable all-terrain berm of claim 1 including stabilizers extending between adjacent braces and engaged with an upper area of each said brace, said stabilizers securing said braces in spaced vertical positions.

9. The transportable all-terrain berm of claim 8 wherein each said stabilizer comprise a rod having a body section with end sections extending generally perpendicular thereof, opposed of said end sections engaging with said upper areas of adjacent of said braces and said support members being engaged with said stabilizers.

10. The transportable all-terrain berm of claim 1 wherein said braces are spaced at between 2 and 6 foot intervals along said side and end wall sections.

11. The transportable all-terrain berm of claim 1 wherein said braces comprise A-frames.

12. A containment system comprising a flexible berm capable of being collapsed and folded for storage and transport and of being assembled to form a containment area for containing fluid:

said containment area being formed of flexible impervious sheeting forming a generally planar floor surrounded by opposed generally vertical side and end walls;

a plurality of generally A-frame braces arranged in spaced generally vertical positions about said flooring in positions to engage with and support said end and side walls, each of said A-frame braces comprising an inner leg connected to an outer leg;

support members carried by said end and side walls;

stabilizer members engaged with upper ends of and extending between adjacent of said A-frame braces, said stabilizer members positioning said A-frame braces in said spaced vertical positions; wherein, said side and end walls are brought into and retained in generally vertical positions, with said support members, and at least said inner legs of said A-frame braces being in engagement with and acting to maintain said side and end walls in said generally vertical positions such that said end and side wall sections reside against said inner legs of said braces when the containment area is empty with said outer legs being angled away from said respective side and end walls below where said inner legs and said outer legs are connected.

13. The system of claim 12 including a bladder formed of flexible impervious material and adapted to store fluid, said bladder being sized to fit into said containment area allowing said containment area to act to contain spillage from said bladder.

14. The system of claim 13 wherein said bladder, when filled, is sized to be spaced from said vertical side and end walls.

15. The system of claim 14 wherein said outer leg of each brace is up to 50% longer than said inner leg, said legs being pivoted together adjacent an upper end of said inner leg and an intermediate point of said outer leg.

16. The system of claim 15 wherein said side and end walls are of a height substantially equal but slightly less than the height of said outer leg.

17. The system of claim 12 including an inwardly directed spill guard formed of said flexible material and connected along one edge with said upper edge of said side and end walls, said spill guard being pivotal in an upward direction.

18. The system of claim 17 including retaining members limiting upward movement of said spill guard.

19. The system of claim 13 wherein said bladder is sized to be engaged with and supported by said vertically extending A-frame braces.

20. The system of claim 13 wherein said end and side walls extend between said braces and said bladder assisting in the support of said bladder.

21. The system of claim 19 wherein said end and side walls extend along a first side of said braces and said bladder extends along a second side of said braces.

22. A method of supporting a fluid filled bladder against rupture and providing a containment for spillage from said bladder:

providing a containment area comprised of flexible sheeting shaped to have flooring connected with side and end wall sections;

providing braces with each brace having an inner leg and an outer leg arranged in generally vertical positions about said flooring so that a lower end of said inner leg and a lower end of said outer leg reside against a supporting surface and each brace including a spacer member for selectively positioning and maintaining lower ends of said inner and outer legs in spaced positions with the spacer member positioned above said lower ends of said inner and outer legs;

supporting said side and end wall sections in generally vertical positions with said braces forming said containment area;

providing said bladder of a size sufficient to apply pressure against said inner legs of said braces when filled and locating said bladder in said containment area; and filling said bladder with fluid causing said braces to support and restrain said filled bladder against outward movement thereby assisting to prevent rupture while said containment provides protection against spillage.

23. A containment berm capable of being collapsed and folded for storage and transport and of being assembled to form a containment area receiving a bladder filled with fluid and protecting against spillage should said bladder break comprising:

flexible impervious sheeting including a floor area engaged along its outer edges with first edges of opposed side and end walls and said bladder positioned on said floor inwardly of said side and end walls;

a plurality of braces arranged in generally vertical positions about said flooring, each brace having an inner leg and outer leg connected at upper ends of said legs, said legs of said braces being operative to engage with and assist in retaining said side and end walls in generally vertical positions and each brace including a spacer member for selectively positioning and maintaining lower ends of said inner and outer legs in spaced positions with the spacer member positioned above said lower ends of said inner and outer legs;

a plurality of retaining members carried by said side and end walls in position to extend beyond second edges thereof, wherein;

said side and end walls are arranged in said generally vertical positions in engagement with said legs of said braces with said retaining members engaged over upper ends of said braces assisting to hold said side and end walls in said generally vertical positions with second edges of said side and end walls positioned generally above said bladder.

24. The containment berm of claim 23 including stabilizer members engaging with said braces, said stabilizer members acting to maintain said braces fixedly spaced and in said generally vertical positions.

25. The containment berm of claim 23 wherein said berm includes a plurality of support members carried by said side and end walls, said support members engaging with said stabilizer members between said braces further assisting in maintaining said side and end walls in said generally vertical positions.

26. A transportable all-terrain berm for collecting fluid comprising:

a containment area formed of flexible impervious sheeting having a floor adapted to lie in a generally horizontal position over a support surface and opposed side and end wall sections connected along first edges with said floor and connected together along opposed end edges;

retaining members extending from second edges of said side and end wall sections at selected spaced positions;

support members extending from said second edges of said side and end wall sections at locations between said retaining members;

a plurality of braces each having first and second upstanding legs pivotally engaged and including a spacer member for selectively positioning and maintaining lower ends of said first and second legs in spaced positions forming said braces generally in the form of an inverted V with the spacer member positioned above said lower ends of said first and second legs;

said containment area is formed with said braces arranged in vertical spaced positions about said floor with upper ends of said braces engaged with said retaining members securing at least spaced sections of said side and end wall sections in generally vertical positions aligned and engaged with at least one of said legs of said braces; and said first legs being longer than said second legs with said pivotal engagement being adjacent an upper end of said second leg and an intermediate section of said first leg and said side and end wall sections being engaged with and supported by both said first and second legs.

27. The transportable all-terrain berm of claim 26 wherein said first legs and second legs are angled toward each other relative to said end and side wall sections such that said end and side wall sections reside against said second legs of said braces and first legs being angled away from said respective end and side wall sections below said intermediate sections of said first legs and extending toward and engaging said respective end and side wall sections above said intermediate sections of said first legs.

28. The transportable all-terrain berm of claim 26 wherein said lower ends of said first and second legs are configured to be positionable against a supporting surface.

29. The transportable all-terrain berm of claim 1 wherein said first legs and second legs being angled toward each other relative to said end and side wall sections such that said end and side wall sections reside against said second legs of said braces and said first legs being angled away from said respective end and side wall sections below said pivotal connection of said first legs between said first legs and said second legs.

30. The transportable all-terrain berm of claim 1 wherein each of said braces being oriented such that said first leg is angle away from said respective end or side wall section as measured from a top end of said first leg toward said lower end of said first leg and said second leg is angle toward said respective end and side wall section as measured from a top end of said second leg toward said lower end of said second leg.

* * * * *